US005392869A

United States Patent [19]

Fröschl et al.

[11] Patent Number: 5,392,869

[45] Date of Patent: Feb. 28, 1995

[54] ANCHOR BOLT DRILLING AND SETTING DEVICE

[75] Inventors: Hermann Fröschl; Ralf Oberdorfer, both of Judenburg; Alfred Zitz, Zeltweg, all of Austria

[73] Assignee: VOEST-ALPINE Bergtechnik Gesellschaft m.b.H., Zeltweg, Austria

[21] Appl. No.: 84,988

[22] Filed: Jul. 2, 1993

[30] Foreign Application Priority Data

Jul. 3, 1992 [AT] Austria ..... 1368/92

[51] Int. Cl.[6] ..... E21C 1/10

[52] U.S. Cl. ..... 175/118; 175/173

[58] Field of Search ..... 175/118, 219, 173, 420.1

[56] References Cited

U.S. PATENT DOCUMENTS

| | | | |
|---|---|---|---|
| 1,812,719 | 6/1931 | Schroder | 175/173 |
| 4,022,026 | 5/1977 | Childress | 175/219 X |
| 4,079,792 | 3/1978 | Paul et al. | 175/219 X |
| 4,108,253 | 8/1978 | Woodford, II | 175/219 X |
| 4,190,385 | 2/1980 | Childress | 175/219 X |
| 4,252,475 | 2/1981 | Cobb et al. | 175/219 X |
| 4,297,057 | 10/1981 | O'Neil | 175/219 X |

*Primary Examiner*—Ramon S. Britts
*Assistant Examiner*—Frank S. Tsay
*Attorney, Agent, or Firm*—Cushman, Darby & Cushman

[57] ABSTRACT

For inserting anchor bolts in the region of the tunnel side wall up to near to the face, in addition to anchor bolt drilling and setting devices for the roof in the front region of the road-driving machine additional anchor bolt and setting devices are mounted displaceably guided in a vertical direction. The additional anchor bolt drilling and setting devices are swivellable around an axis which is parallel to the running surface plane of the drive mechanism of the road-driving machine.

7 Claims, 5 Drawing Sheets

ANCHOR BOLT DRILLING AND SETTING DEVICE

BACKGROUND OF THE INVENTION

1. Field of the Invention

The invention relates to anchor bolt drilling and setting device for inserting anchor bolts in the region of the tunnel side wall up to near to the face.

2. Description of the Related Art

Anchor bolt drilling and setting devices for this purpose can be found in GB-A-2229945, for example. The known construction for an anchor bolt drilling and setting device assumes a manipulator which may be swivelled in all directions and is multiply bendable, which should make it possible to drive both roof anchor bolts and anchor bolts into the tunnel side wall or gallery side walls from one and the same basic position using an anchor bolt drilling and setting device. In view of the fact that it is fixed to a defined point of the frame structure of the road-driving machine, this kind of manipulator has to be able to span large distances, which could naturally give rise to a number of operating conditions in which the stability is lower than it is in other operating positions. In particular, it should be assumed that with roof anchor bolts the distance is usually different from the distance which would be necessary to set anchor bolts in the tunnel side wall. With selective cutting machines, in which these kinds of anchor bolt drilling and setting devices are usually used, the jib may be used to cover a larger or smaller swivel range in a vertical direction. The cutting tools may also be swivelled out laterally from the machine's longitudinal axis on the same cutter bar, during which as a whole the face is a part of a calotte-type dome. If the anchoring is to be performed close to the face, naturally a combined device for anchoring in the roof and in the tunnel side wall is only able to access different positions over a relatively large adjusting distance of the anchor bolt drilling and setting device. If the length of the anchor bolt drilling and setting device is pre-specified, the manipulator has to ensure that this device may be swivelled in all directions, which in certain positions, particularly for setting anchor bolts in the tunnel side wall, cannot exclude the possibility of a collision of the rear end of the anchor bolt drilling and setting device with the jib for the cutting tools. Although devices which are intended exclusively for anchoring in the roof are usually adjustable in a substantially vertical direction and may be constructed so that in principle they cannot collide with the cutter bar which can move over the face, at least when such devices are intended to swivel far enough to enable the same anchor bolt drilling and setting devices to drive anchor bolts into the tunnel side wall they cannot be freely adjusted at the tunnel side wall without colliding with the cutter bar. Furthermore, it is not usually possible to use such devices to set anchor bolts parallel to each other in the tunnel side wall, as the swivel kinetics only permit drill holes which more or less intersect each other or are at a skew to each other to be driven in the tunnel side wall.

In principle, the use of anchor bolt drilling and setting devices for anchoring work in the tunnel side wall region which differ from the anchor bolt drilling and setting devices used for the roof is known; for reasons of space, such known devices are usually arranged at a long distance from the face on stationary parts of the road-driving machine. So far, an arrangement of such separate anchor bolt drilling and setting devices for the tunnel side wall with the possibility of being able to set any drill holes in the tunnel side wall region and, in particular, drill holes parallel to each other in the tunnel side wall region near to the face, has not been suggested, clearly because of the limited spatial relationships in the face region and the risk of such devices colliding with a jib or cutter bar of a road-driving machine.

SUMMARY OF THE INVENTION

It would be desirable to be able to provide an anchor bolt drilling and setting device which also enables drilling and anchoring to be performed in the tunnel side wall in the immediate vicinity of the face, and in particular which offers the possibility of having no devices protruding over the side part of the cutting or road-driving machine when in non-operational setting and, when in operation, the possibility of making drill holes and anchorings which are parallel to each other in a plurality of points of the tunnel side wall above one another.

The present invention provides an arrangement in which, in addition to anchor bolt drilling and setting devices for the roof, additional anchor bolt drilling and setting devices are mounted displaceably guided in a vertical direction in the front region of the road-driving machine, with the additional anchor bolt drilling and setting devices being swivellable around an axis which is parallel to the running surface plane of the driving mechanism for the road-driving machine.

Because additional anchor bolt drilling and setting devices are provided, there is no longer a requirement to allow for complete swivelling ability and attainability of the roof and tunnel side wall with one anchor bolt drilling and setting device, and such anchor bolt drilling and setting devices may be designed for operation on the tunnel side wall only. Because now a displacement of such additional anchor bolt drilling and setting devices in a vertical direction along a guide is provided, it becomes possible to drive drill holes which are parallel to each other into the tunnel side wall near to the face and to anchor them in the same direction, with the swivel ability of the additional anchor bolt drilling and setting devices around an axis substantially parallel to the running surface plane of the driving mechanism for the road-driving machine allowing even inclined drilling in the direction of the roof or the floor and the setting of additional anchor bolts in the edge regions, which would not be attainable with a vertical parallel displacement of the anchor bolt drilling and setting device.

Advantageously, the construction is such that the bearing for the displacement in a vertical direction is formed by a sleeve-like part which at least partly encompasses a vertical guide rod and on which the swivel axis which is parallel to the running surface plane is constructed. This produces a particularly simple, stable, and substantially mechanically protected construction. The construction of this kind of vertical guide rod with a part which wholly or partially encompasses the guide rod enables the realisation of a small and stable drive which is near the middle of the machine and when in non-operational setting has no parts protruding over the lateral outline of the machine. Advantageously, the construction is such that the sleeve is adjustable in a vertical direction by means of a cable or chain drive in the style of a block and pulley, and this is able to guarantee a particularly simple compact and stable drive. This kind of block and pulley may, for example, be used to appropriately multiply the adjustment range of a small lifting cylinder or pressure cylinder and, for example, a transmission ratio of 1:4 may be used, which means a single movement of the lifting cylinder may be used to provide a quadruple movement of the sleeve and hence of the anchor bolt drilling and setting device parallel to itself in a vertical direction along the tunnel side wall.

An additional freedom of movement without dispensing with high stability and with the simultaneous reliable take up of all the forces can be realised in that the construction is such that the sleeve is mounted with limited swivelling ability around the vertical guide rod. Because all the swivelling ability is substantially concentrated in the sleeve region and this component which is displaceable in a vertical direction, i.e. the sleeve, may be arranged on a protected point which is out of the way of the direct influence of falling stones, in addition to high stability, a high degree of operational reliability and reduced vulnerability is offered.

Advantageously, the construction is such that the anchor bolt drilling and setting devices may be swivelled in a basic setting in which they are substantially parallel to each other and are mounted so that they may be lowered onto a platform in this basic setting. This enables a non-operational setting in which no parts protrude laterally over the frame or driving mechanism of the. road-driving machine.

The platform which in this connection is provided as a stop for the lowest setting of the anchor bolt drilling and setting device offers, in a simple form, space for one operator, who can monitor the work of the anchor bolt drilling and setting device for the tunnel side wall. Advantageously this kind of platform may be constructed so that it overlaps the caterpillar crawlers of the driving mechanism of the road-driving machine in the front region of the latter so that it is ensured that the anchoring can take place reliably up to near to the face even in the tunnel side wall region. Advantageously, the construction here is such that the vertical guide rod on the internal side of the platform facing the machine's longitudinal axis is fixed above this platform on the machine frame, which provides maximum protection to the parts of the drive and the mounting. In addition to a high degree of operational reliability, due to the protected arrangement of the parts of the drive and the mounting, this kind of compact construction also provides the possibility of driving drill holes which are parallel to each other at any height over a large tunnel side wall height and of anchoring them in the same direction.

BRIEF DESCRIPTION OF THE DRAWINGS

The invention will be described in more detail in the following using a schematic illustration in the accompanying drawings of an embodiment of anchor bolt drilling and setting apparatus and its attachment to a road-driving machine.

DESCRIPTION OF THE PREFERRED EMBODIMENT

Figure 1:
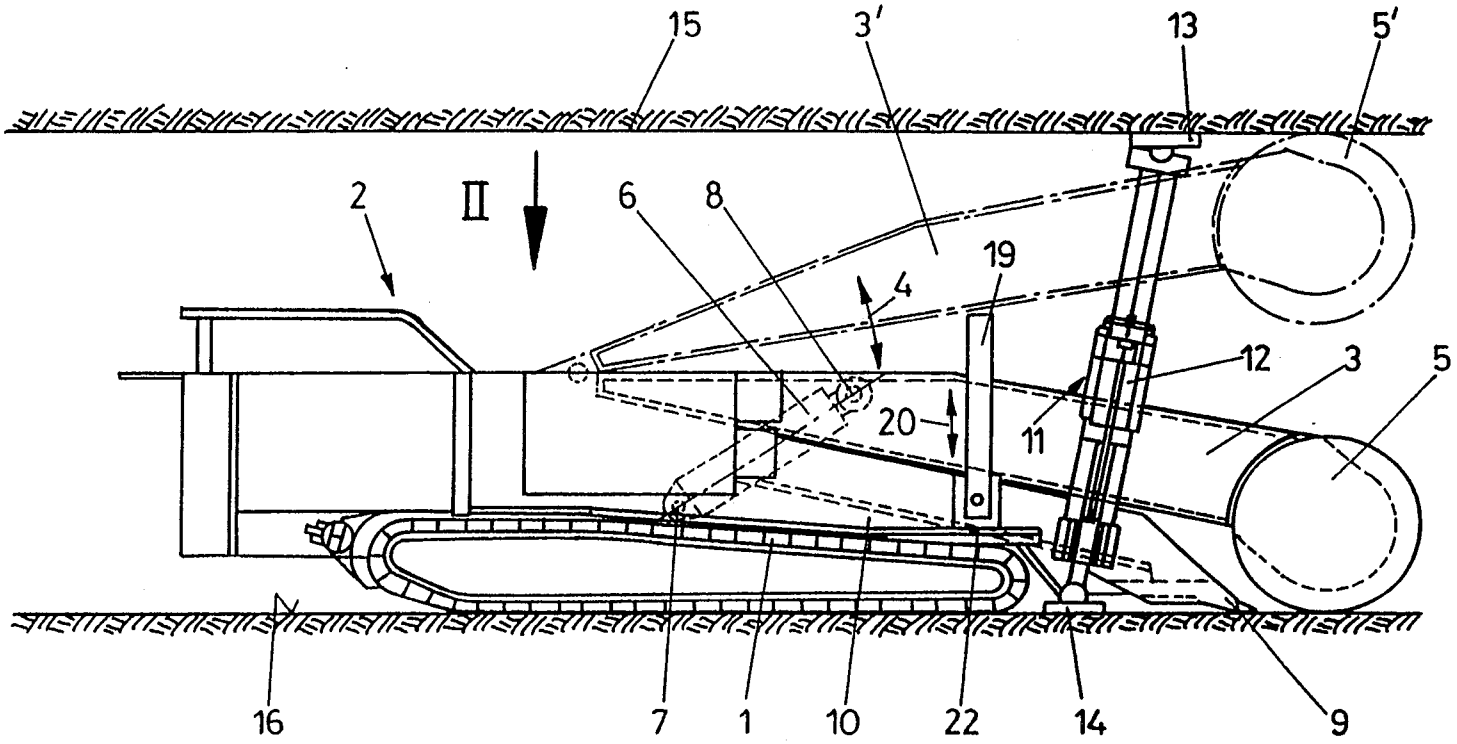
FIG. 1 shows a side view of a road-driving machine with anchor bolt drilling and setting devices for the insertion of anchor bolts in the tunnel.
Figure 2:
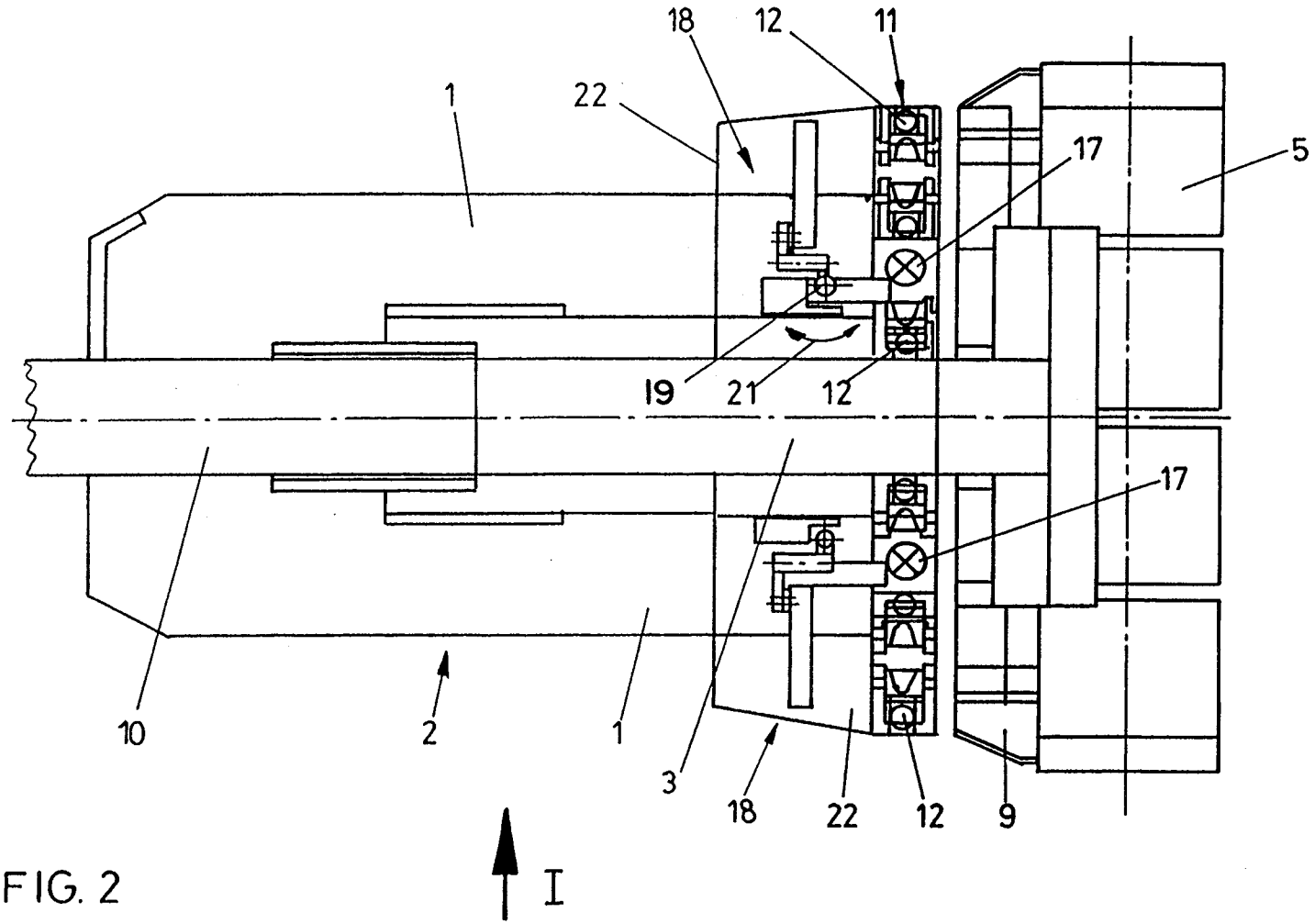
FIG. 2 shows a top view of the embodiment according to FIG. 1 according to arrow II in FIG. 1, with FIG. 1 being a view in the direction of arrow I in FIG. 2.

FIG. 1 and 2 show a road-driving or cutting machine 2 which can travel on a crawler drive mechanism 1 with a rotatably mounted cutter drum 5 vertically swivel-mounted in the direction of the double arrow 4 on a jib 3. The swivelling ability of the jib 3 is here achieved by a cylinder and piston unit 6, which at 7 is swivel-mounted on the machine frame of the cutting machine and at 8 is swivel-mounted on the jib. Here, the solid line indicates the lowered setting of the cutter bar 3 and the cutter drum 5, whereas a raised position is shown by dotted lines at 3′ and 5′ respectively.

Here, the cutter drum is driven in a known manner, for example by a motor arranged in jib 3. However, for reasons of clarity these details are not shown. Instead of a cutter drum, cutting heads may be provided, in this case jib 3 additionally being swivel-mounted on a vertical axis to cover the entire face.

To displace the cut or broken material, the cutting machine 2 also has a loading device 9, formed from a ramp, which merges into a conveyor 10 running in the machine's longitudinal direction, the latter only shown diagrammatically.

In the region of the front end of the machine, immediately behind the cutting drum 5, a frame 11 is provided to which a plurality of anchor bolt drilling and setting devices 12 are connected for setting anchor bolts in the roof, which at intervals from each other extend crosswise over virtually the whole width of the worked out face, as is clearly shown in FIG. 2. Here, the frame 11 is connected to the cutting machine in a suitable manner. FIG. 1 also shows supporting plates 13 and 14 for pressing the frame 11 against the roof 15 and the floor 16. The frame is supported by rams 17 on the roof and floor, with rams 17 being arranged between the anchor bolt drilling and setting devices 12. When the rams constructed as cylinder and piston units 17 are lowered, the roof bars 13 are withdrawn from the roof 15 and the floor plates 14 are lifted up to thus enable the manoeuvring of the whole cutting machine 2. The whole length of the frame 11 may be used to move the anchor bolt drilling and setting devices 12 so that in particular even long anchor bolts may be set. Further, once the frame 11 has been fixed by a bracing between the roof and the floor, it is possible to set a plurality of anchor bolts in a defined way simultaneously. In a construction using cutting heads, the position of the anchor bolt drilling and setting devices 12 for the roof must be matched to the additional lateral swivelling of the cutting arm.

In addition to the anchor bolt drilling and setting devices 12 for setting or drilling in the roof 13, additional anchor bolt drilling and setting devices 18 are provided in the region immediately behind the frame 11 and the anchor bolt drilling and setting devices 12 to enable the setting of anchoring bolts in the tunnel side wall or other side walls. These additional anchor bolt drilling and setting devices are mounted to be displaceable in a vertical direction on guides 19, diagrammatically illustrated in FIGS. 1 and 2, in the direction of the double arrow 20, as will be shown in more detail in the following figures. In addition the anchor bolt drilling and setting devices 18 may be swivelled around the guide or guide rod 19 in the direction of double arrow 21 at an angle of for example ±12° for drilling or setting anchor bolts in the tunnel side wall.

The additional anchor bolt drilling and setting devices 18 are arranged in the region of a platform 22, with the guide rod 19 anchored on this platform 22 and/or on directly adjoining parts of the machine frame, for example surrounding the conveyor 10. The platform 22 covers the front region of the caterpillar crawler driving mechanism 1 of the road-driving or cutting machine 2. In this way the platform 22 is arranged protected behind the frame 11 and the anchor bolt drilling and setting devices 12 for setting anchor bolts in the roof and can serve as a standing area for an operator of the additional anchor bolt drilling and setting devices 18.

Figure 3:
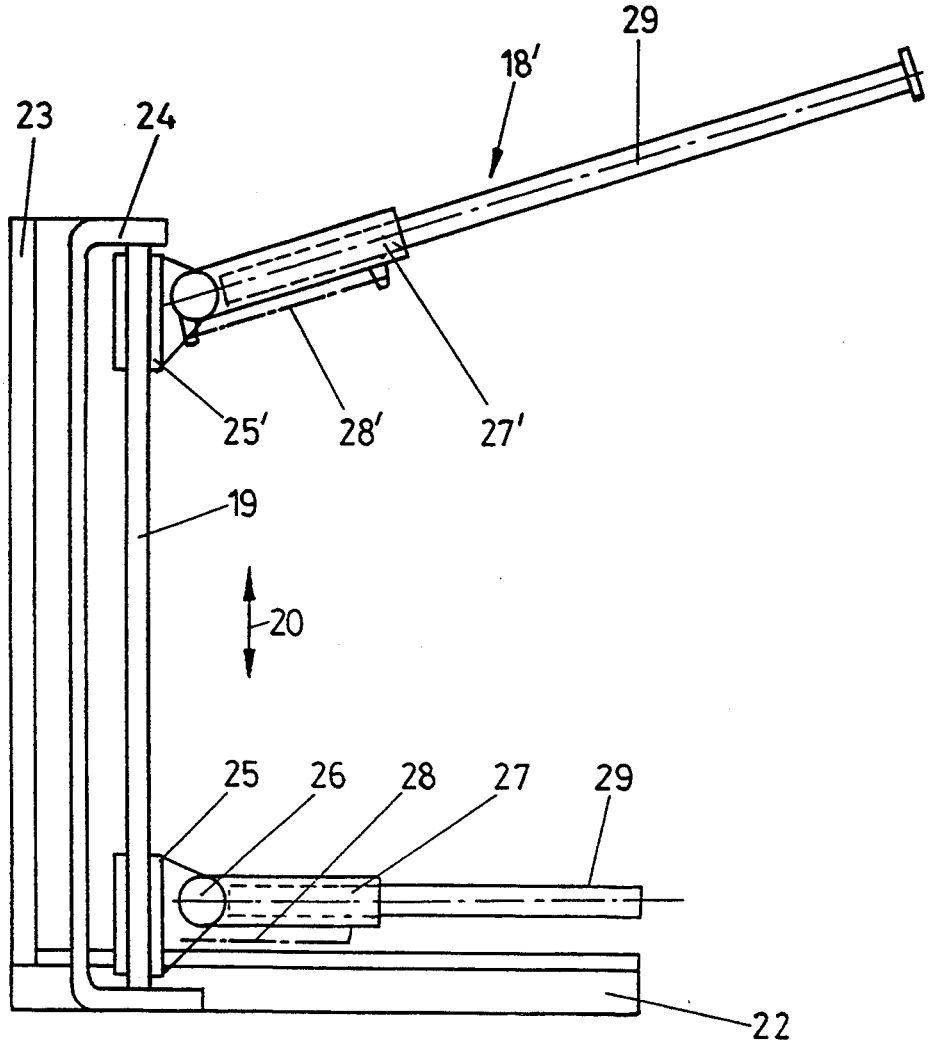
FIG. 3 shows in detail an anchor bolt drilling and setting device and its guide on the road-driving machine.

FIG. 3 shows the anchor bolt drilling and setting device 18 for drilling and setting anchor bolts in the tunnel side wall or other side walls. The guide rod 19 is positioned on the platform 22 and on a part 24 which is connected to the machine frame indicated diagrammatically by 23 in the diagram. The guide rod 19 is encompassed by a part which partially encompasses this rod 19 in the form of a sleeve 25. On the sleeve 25, an articulated arm 27 is swivel-mounted around an axis 26 which is substantially parallel to the plane of the platform 22 and hence to the running surface plane of the whole road-driving machine, with the drive for swivelling this articulated arm 27 being, for example, formed by a diagrammatically illustrated hydraulic cylinder and piston unit 28. The actual anchor bolt drilling and setting device, which is diagrammatically illustrated by 29, is mounted on the articulated arm 27. FIG. 3 shows the articulated arm 27' swivelled into a raised position with the anchor bolt drilling and setting device in operational setting illustrated by 29'. The anchor bolt drilling and setting device for setting anchor bolts in the tunnel side wall or other side walls is thus displaceable in a vertical direction, guided in the direction of double arrow 20 by the sleeve 25 encompassing the vertical guide rod 19, with in addition it also being possible to make inclined drill holes in the tunnel side wall or other side wall by means of the articulated arm 27. The swivel angle here may be ±45° for example. By displacing the articulated arm 27 in a substantially vertical direction, it is possible over a wide range in the tunnel side wall to make drill holes which are completely parallel to each other and to set parallel anchor bolts correspondingly. In addition, sleeve 25 may be swivelled to a limited extent around the axis defined by guide rod 19, so that it is also possible to set anchors in a direction deviating from the normal direction of the machine's longitudinal direction, so that for example in advance anchor bolts may be inserted in a direction forming an acute angle with the machine's longitudinal axis. This kind of drive for swivelling the sleeve 25 or the whole anchor bolt drilling and setting device 18 around the guide rod 19 is not shown in FIG. 3 for reasons of clarity.

FIG. 3 also shows that in withdrawn or folded setting the additional anchor bolt drilling and setting device 18 does not protrude over the side edge of the machine, as defined for example by the platform 22.

Figure 4:
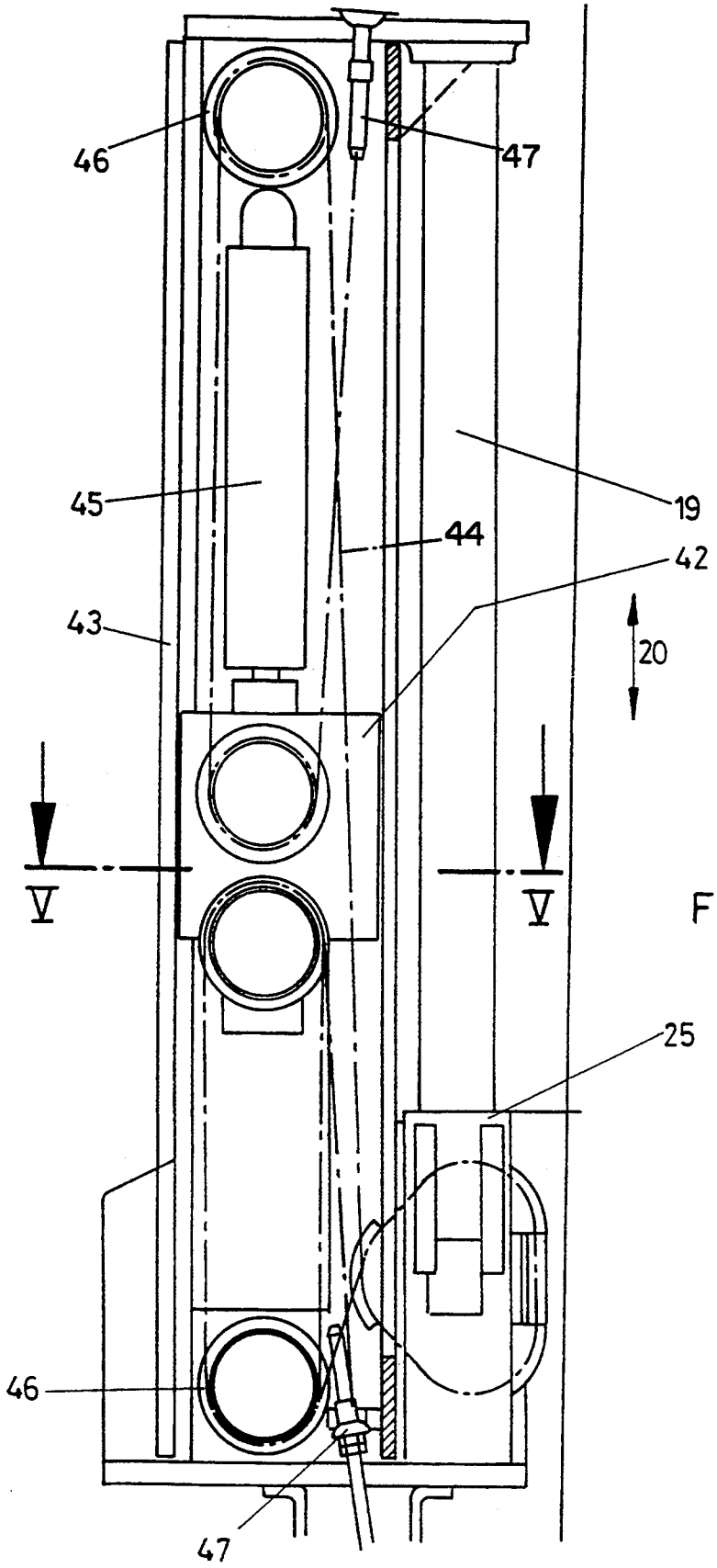
FIG. 4 shows in detail an enlarged illustration and partial section of the guide of the anchor bolt drilling and setting device according to the construction in FIG. 3 and the possibility of adjustment in a vertical direction.
Figure 5:
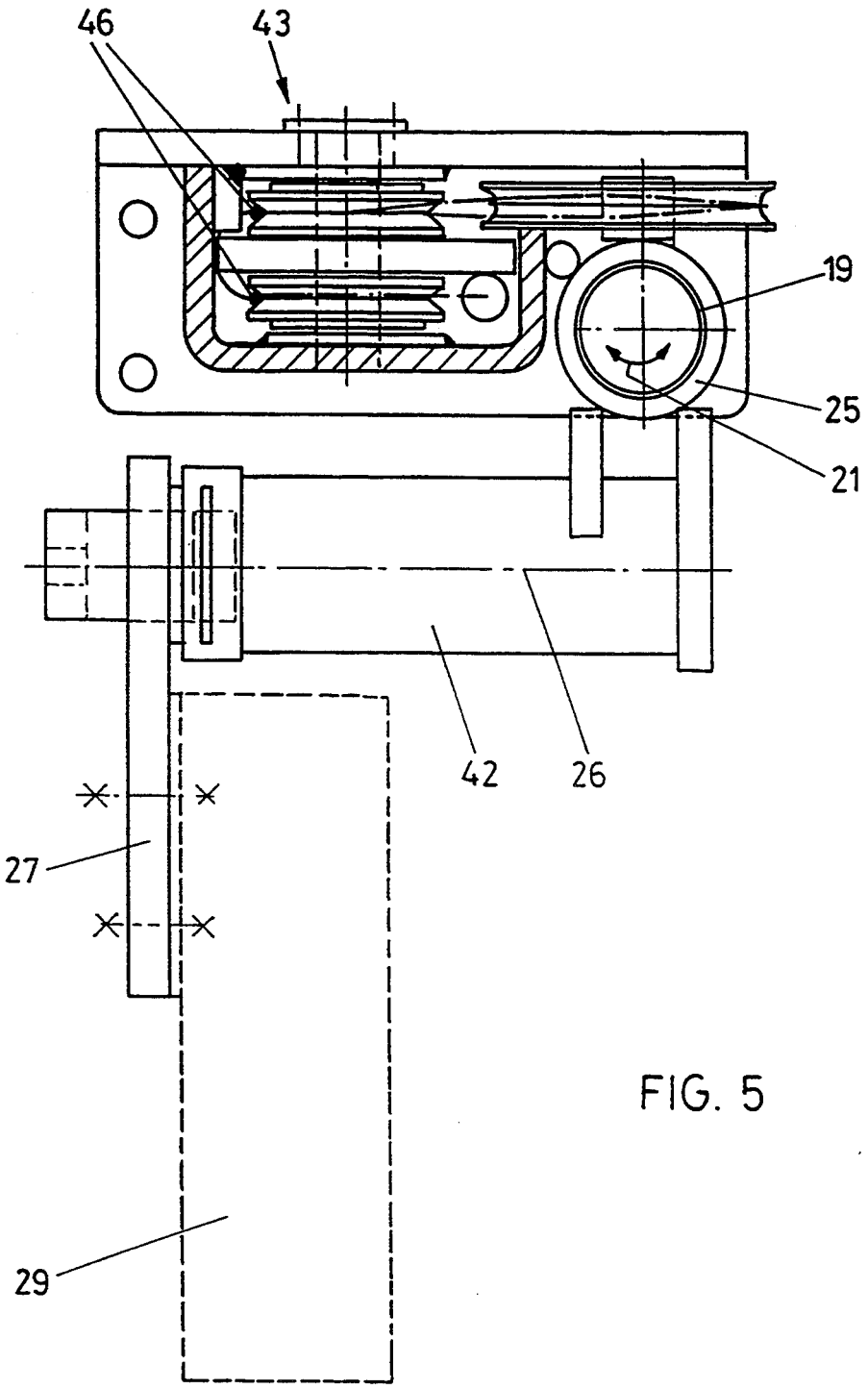
FIG. 5 shows a section according to the line V—V in FIG. 4, again on an enlarged scale, through a lifting drive for the anchor bolt drilling and setting device.

FIGS. 4 and 5 show in detail a drive for the height-adjustability of the anchor bolt drilling and setting device 18 in the direction of the double arrow 20. The adjustment of the anchor bolt drilling and setting device 18 in the direction of the double arrow 20 takes place by means of a block and pulley mounted in a casing 43 directly adjacent the guide rod 19, with suitable deflection of the cable or chain 44 of the block and pulley providing a suitable transmission ratio. The vertical adjustment here takes place by means of a cylinder and piston unit 45 which is mounted in the interior of component 43, where as a whole deflecting the cable pull round the rollers each generally designated 46 in FIGS. 4 and 5 has the result that a displacement distance of the cylinder and piston unit of a certain amount x corresponds to a displacement distance of the sleeve 25 or the anchor bolt drilling and setting device by four times the amount x. In FIG. 4 the fixing points of the cable pull 44 are designated 47. The cable pull 44 is guided over the sleeve 25 in the specified way to produce such a conversion of the movement of one stop of the cylinder and piston unit 45 into a corresponding movement in a vertical direction of sleeve 25 and hence the whole additional anchor bolt drilling and setting device 18 for drilling and anchoring in the tunnel side wall region.

The pivot bearing 42 adjoins the sleeve 25 which surrounds the vertical guide rod so that the articulated arm 27 is swivel-mounted on axis 26.

We claim:

1. Anchor bolt drilling and setting apparatus for inserting anchor bolts in interior roof and side-wall surfaces of a tunnel, said apparatus being mounted on driven platform movable along said tunnel, the apparatus comprising:

first anchor bolt drilling and setting devices, mounted on a front region of the movable platform, for inserting anchor bolts in said roof surface of the tunnel; and second anchor bolt drilling and setting devices, mounted on said front region adjacent the first anchor bolt drilling and setting devices, for inserting anchor bolts in said side-wall surfaces of the tunnel, said second devices being displaceable along a vertical axis extending between the driven platform and the roof surface and further being swivellably displaceable about said vertical axis.

2. Apparatus according to claim 1, wherein said second device is joined to a sleeve member mounted on a vertical guide rod positioned along the vertical axis, said sleeve member being swivellably movable relative to the guide rod.

3. Apparatus according to claim 2, further comprising a block and pulley drive joined to said sleeve member for displacing the sleeve member along the vertical guide rod.

4. Apparatus according to claim 2, further comprising means for limiting swivelling movement of the sleeve member relative to the vertical guide rod.

5. Apparatus according to claim 1, further comprising means for swivelling each of said second anchor bolt drilling and setting devices to positions in which they are substantially identically oriented relative to the sidewall surfaces of the tunnel and for lowering the devices towards said platform when they are so oriented.

6. Apparatus according to claim 5, wherein said platform is supported on a crawler drive mechanism, said platform being dimensioned to overlap the crawler drive mechanism along sides of the platform adjacent the side-wall surfaces of the tunnel.

7. Apparatus according to claim 6, wherein when the second devices are oriented substantially identically relative to the sidewall surfaces of the tunnel and are lowered towards said platform, the devices do not overlap said sides of the platform.

* * * * *